US008256987B2

(12) United States Patent
Awrath

(10) Patent No.: US 8,256,987 B2
(45) Date of Patent: Sep. 4, 2012

(54) OSCILLATION EXCITER

(75) Inventor: Martin Awrath, München (DE)

(73) Assignee: Wacker Neuson Produktion GmbH & Co. KG, Munich (DE)

( * ) Notice: Subject to any disclaimer, the term of this patent is extended or adjusted under 35 U.S.C. 154(b) by 533 days.

(21) Appl. No.: 12/439,867

(22) PCT Filed: Sep. 5, 2007

(86) PCT No.: PCT/EP2007/007752

§ 371 (c)(1),
(2), (4) Date: Nov. 6, 2009

(87) PCT Pub. No.: WO2008/028652

PCT Pub. Date: Mar. 13, 2008

(65) Prior Publication Data

US 2010/0074685 A1 Mar. 25, 2010

(30) Foreign Application Priority Data

Sep. 6, 2006 (DE) ..... 10 2006 041 784

(51) Int. Cl.
*E01C 19/30* (2006.01)
*E01C 19/32* (2006.01)

(52) U.S. Cl. ..... 404/133.1; 404/133.05

(58) Field of Classification Search ..... 404/133.05, 404/133.2, 133.1; 173/90, 124, 29, 113, 173/132; 279/16–18, 55, 66
See application file for complete search history.

(56) References Cited

U.S. PATENT DOCUMENTS

| | | | | |
|---|---|---|---|---|
| 3,024,861 | A * | 3/1962 | Clynch | 181/114 |
| 3,283,677 | A * | 11/1966 | Uebel | 404/113 |
| 3,427,939 | A * | 2/1969 | Fox et al. | 404/133.2 |
| 3,732,022 | A * | 5/1973 | Danuser | 404/113 |
| 3,746,149 | A | 7/1973 | Schrader | |
| 3,909,148 | A * | 9/1975 | Vural et al. | 404/133.05 |
| 4,113,403 | A * | 9/1978 | Tertinek et al. | 404/113 |
| 5,439,314 | A * | 8/1995 | Wadensten | 404/133.05 |
| 5,672,027 | A * | 9/1997 | Wadensten | 404/133.05 |
| 6,213,681 | B1 * | 4/2001 | Sick et al. | 404/133.05 |
| 6,435,767 | B1 * | 8/2002 | Steffen | 404/133.1 |
| 6,722,815 | B2 * | 4/2004 | Fervers | 404/75 |
| 6,837,648 | B1 * | 1/2005 | Wadensten | 404/117 |
| 7,354,221 | B2 * | 4/2008 | Congdon | 404/84.1 |

FOREIGN PATENT DOCUMENTS

| | | |
|---|---|---|
| FR | 2 099 414 A | 3/1972 |
| WO | 02/44475 A | 6/2002 |

* cited by examiner

*Primary Examiner* — Gary Hartmann
*Assistant Examiner* — Abigail A Risic
(74) *Attorney, Agent, or Firm* — Boyle Fredrickson, S.C.

(57) ABSTRACT

An oscillation exciter, in particular for a vibration plate, has a rotating unbalanced mass (3) for producing a non-directional oscillation which is transmitted to a ground contact element (1). In order to transmit the oscillation to the ground contact plate (1), a transmission device (7, 8) is provided, which connects the unbalanced shaft (3) to the ground contact element (1) and by means of which the non-directional oscillation of the unbalanced shaft (3) can be converted to a directional oscillation for the ground contact plate (1). The transmission device (7, 8) is designed such that, with respect to an oscillation plane, it has different and variable stiffnesses in different directions within the oscillation plane.

19 Claims, 9 Drawing Sheets a)

b)

OSCILLATION EXCITER

The present invention relates to an oscillation exciter as recited in the preamble of patent claim 1. Vibration plates for soil compacting are standardly equipped with an oscillation exciter in which one, two, or more unbalanced shafts are rotationally driven. The unbalanced shafts bear an unbalanced mass that produces a non-directional oscillation during rotation. Smaller vibration plates (plate compactors) often have an oscillation exciter having only one unbalanced shaft that, during rotation, lifts a soil contact element from the soil that is to be compacted and drives it forward. In larger vibration plates, an oscillation exciter is used having, for example, two unbalanced shafts that are coupled so as to be capable of rotation in opposite directions. Due to the opposite rotation of the unbalanced shafts, the force vectors of the unbalanced forces are summed in such a way that a resultant force arises that acts in only one direction, which however is generally capable of being set, while force components perpendicular thereto cancel each other. Such vibration plates can easily be steered forward and backward.

If the unbalanced shafts have a plurality of unbalanced masses that are offset axially to one another and whose position relative to the unbalanced shaft bearing them can be independently adjusted, the vibration plate can also be steered.

The two unbalanced shafts rotating in opposite directions each produce in themselves a circulating, non-directional oscillation. However, the interaction of the unbalanced shafts forms a directional oscillation. The adjustment of the oscillation direction can be accomplished by modifying the phase position of the unbalanced shafts.

In order to enable a directional oscillation to be produced in this way, the oscillation exciter must have at least two unbalanced shafts. In addition, an adjustment mechanism is necessary for the modification of the phase position of the rotating unbalanced shafts.

On sensitive soil surfaces, such as asphalt or paving stones, there is in addition the problem that a strong oscillation effect causes an excessive compacting of the surface, so that for example the paving stones are sunk too deeply into the soil. This problem arises in particular when a vibration plate is at a standstill or in reverse operation, in which a change of direction has to be carried out between forward and backward travel. This is because at the point of reversal the two oppositely rotating unbalanced shafts produce a vertical resultant force whose action goes entirely to compacting the soil, even if no compacting of the soil is desired at that time.

In order to enable the centrifugal force of the oscillation exciter to be completely compensated at the reverse point, it is known to provide four differently movable unbalanced masses in an oscillation exciter, whose relative position can be set using at least two adjustment devices. A steerable vibration plate requires at least three different movable unbalanced masses, as well as at least two adjustment devices with which the position of the unbalanced masses relative to the unbalanced shafts bearing them can be set.

The present invention is based on the object of indicating an oscillation exciter in which the mechanical outlay for producing a directional oscillation is reduced. The oscillation exciter should preferably be capable of avoiding the production of an oscillation at the reverse point or changeover point. The oscillation exciter should also preferably be suitable for use in a steerable vibration plate.

This object is achieved according to the present invention by an oscillation exciter as recited in patent claim 1. Advantageous developments of the present invention are defined in the dependent claims.

An oscillation exciter according to the present invention has at least one unbalanced mass, rotationally driven about at least one unbalanced axis, for the production of a non-directional oscillation. In addition, a component that is to be charged by the oscillation and a transmission device, connecting the unbalanced mass to said component, for transmitting the oscillation to said component are also provided. The oscillation exciter is characterized in that the transmission device is capable of transmitting or converting the non-directional oscillation from the unbalanced mass into a directional oscillation for the component.

As stated above, up to now only two designs have been known for producing oscillation in vibration plates. Either a non-directional oscillation is introduced into the component (e.g. the soil contact plate of the vibration plate), as is standard in a plate compactor, or two non-directional oscillations are produced whose superposition results in a directional oscillation. Alternatively, from conveyor technology it is known in oscillating tables to convert a non-directional oscillation into a directional oscillation having an unchangeable oscillation direction, using a suitable transmission device. However, because in particular applications, such as a vibration plate, it is not directional oscillation as such but rather the modification or adjustability of the oscillation that provides an additional functionality, the oscillation production known from oscillating tables is not suitable for use in vibration plates. In contrast, the conversion, through corresponding design of the transmitting device, of only one non-directional oscillation into an essentially directional oscillation whose direction and/or intensity can be modified is not known. In the technical realization of the present invention, it will not be possible to achieve a directional oscillation that is pure in the physical sense. Rather, the construction according to the present invention of the oscillation exciter realizes an essentially directional oscillation that must exhibit a slightly elliptical movement. Nonetheless, for simplification the expression "directional oscillation" is used hereinafter, even if an "essentially directional oscillation" is present.

The transmission device can be constructed in such a way that the direction of the transmitted directional oscillation is capable of being modified. It is likewise possible for the direction of the directional oscillation to be capable of being modified not only in the rest state but also during operation, for example using an operating element or a control device. Through modification of the direction of the directional oscillation it is possible on the one hand to change the direction of travel (forward, backward). Moreover, given a corresponding construction of the oscillation exciter it is possible to produce yaw moments about a vertical axis, so that a vibration plate equipped with the oscillation exciter according to the present invention is steerable.

The transmission device can be constructed such that, relative to an oscillation plane, it has different stiffnesses in different directions within the oscillation plane. The rotating unbalanced mass can correspondingly be connected to the exciting component in at least partially elastic fashion. By modifying the coupling of the unbalanced mass, the orientation of the transmitted oscillation and its intensity can be modified. In the direction in which the transmission device has a relatively low stiffness, the transmission device can transmit no oscillations, or only slight oscillations. To this extent, the transmission device acts as an oscillation insulator in this direction.

In contrast, in a direction in which the transmission device ensures a high degree of stiffness, or a quasi-rigid coupling, between the unbalanced mass or the rotating unbalanced shaft on the one hand and the component that is to be charged on the other hand, the oscillation produced by the unbalanced mass can be transmitted completely to the component. In this direction, oscillation insulation does not take place, or takes place only to a negligible extent.

The different stiffnesses of the transmission device, relative to the oscillation plane or to space, thus ensure a different transmission of the non-directional oscillation produced by the unbalanced mass. While a part of the non-directional oscillation is not transmitted by the transmission device (given elastic mounting), another part can be transmitted to the component (given rigid mounting). Which part of the non-directional oscillation is transmitted depends on the directional effect of the stiffnesses in the transmission device. The transmission device thus acts to a certain extent as a filter that allows only a certain part of the non-directional oscillation to act on the component, and thus converts the non-directional oscillation into a directional oscillation.

Through a soft, elastic mounting provided by the transmission device, the above-named component can also be held at rest, i.e., no, or only slight, oscillations are transmitted to the component even when the unbalanced mass is rotating. By adjusting, controlling, or modifying the transmission device, a stiffer connection having a particular spatial direction can be activated, in which direction the oscillating movement produced by the rotating unbalanced mass is then transmitted to the component that is to be excited.

The stiffnesses can be capable of being modified during operation of the oscillation exciter. In this way, the oscillation acting on the component, or the forces caused by the oscillation, can be modified in order to achieve a desired directional effect, such as a steering effect or forward or backward travel.

The transmission device can have at least two connection devices situated in a path of transmission of the oscillation from the unbalanced mass to the component, the stiffness of at least one of the connection devices being independent of, or differing from, the stiffness of the other connection device. In this way, it is possible for the transmission device to have different stiffnesses in different spatial directions.

For this purpose, the stiffness of the one connection device during operation can be individually set in such a way that it differs from the stiffness of the other connection device. The connection devices can be situated parallel and/or in series to one another, relative to the path of transmission of the oscillation from the unbalanced mass to the component that is to be excited. In this way, the effects of the connection devices can also be superposed.

The stiffnesses can have a directional component and a magnitude component, so that, correspondingly, the stiffness effect of a connection device is capable of being modified with respect to its directional effect and/or its magnitude. This means that the stiffness, or the stiffness effect, of a connection device can be modified by modifying the magnitude of the stiffness. However, it is also possible to leave the stiffness magnitude unmodified in itself, but to modify the directional effect of the stiffness. For example, the connection device can be constructed in such a way that, depending on the orientation in space, it acts optionally in one direction and in another direction as a soft mounting and as a stiff mounting. Likewise, the magnitude of the stiffness can be modified while maintaining the directional effect.

Correspondingly, the stiffnesses of the connection devices can differ from one another in such a way that they differ with respect to a particular spatial direction.

In a specific embodiment, the non-directional oscillation and the directional oscillation run essentially in a plane of oscillation perpendicular to the unbalanced axis. The transmission device can have, in a first spatial direction situated in the plane of oscillation, a first connection device for the unbalanced mass that acts in the first spatial direction, and, in a second spatial direction differing from the first spatial direction and also situated in the plane of oscillation, a second connection device acting in the second spatial direction. The stiffnesses of the connection devices are here permanently or temporarily different with regard to the spatial directions respectively allocated to them. In this way, it can be achieved that the transmission device has different stiffnesses in different spatial directions, in order to convert the at first non-directional oscillation into a directional oscillation for the component.

In a particular operating state, the connection devices are capable of being controlled in such a way that the stiffnesses of the connection devices are equal. If, for example, the connection device brings about a stiff mounting of the rotating unbalanced mass in all spatial directions, the non-directional oscillation is transmitted to the component as a non-directional oscillation. In this way, in a vibration plate an effect can be achieved that is comparable to the manner of operation of a plate compactor.

If, in contrast, all connection devices have a low stiffness, the non-directional oscillation is not transmitted to the component, or is transmitted to the component only slightly. This manner of operation is suitable above all for standstill operation of the vibration plate, if no oscillations are to be introduced into the soil by the component (e.g. the soil contact plate). This operating mode is particularly advantageous for the reversing of the vibration plate, if a change of direction (forward-backward) is to take place and a sensitive soil is being compacted.

The magnitude component of the stiffness of a connection device can for example be non-modifiable, while the directional component of the stiffness is modifiable as a function of a modifiable orientation of the connection device to the unbalanced mass. In this way, it is possible as a result to set the stiffness effect of the connection device with respect to the transmission of the non-directional oscillation and the conversion to directional oscillation.

Alternatively, the magnitude component of the stiffness of a connection device can be non-modifiable, while the connection device provides different stiffness effects in different spatial directions.

The stiffnesses of the connection devices can be modified between at least two stiffness effects. Depending on the control and technical outlay, however, it is also possible to set a plurality of intermediate positions that the operator can use for a finer-grained control of the oscillation exciter and thus of the vibration plate.

Finally, it is also possible for the stiffnesses of the connection devices to be modifiable in sliding fashion, so that almost any intermediate positions can be set. In this way, the oscillation transmitted to the component can be modified as desired.

Depending on the specific embodiment, one of the connection devices can have at least one damping device, a friction-fit device, a positively fitting fastener or retaining device, or a spring device. Here it is useful if the connection device is adjustable in some way in order to enable the desired modification of the stiffness effect to be brought about.

At least one of the connection devices can have a plurality of levers connected to one another in pivotable fashion, enabling different stiffness relative to a particular spatial direction as a function of the pivot position. Here it is helpful if the lever positions are fixedly defined by the passing of dead center points.

An operating device may be provided for the modification of the stiffness of at least one of the connection devices. This gives the operator the capability of modifying the stiffness of the connection device during standstill, but also during operation.

The unbalanced mass that produces the non-directional oscillation can be formed by one or more unbalanced shafts. It is also possible for a plurality of oscillation exciters, each made up of only one unbalanced shaft, to charge a common component. However, a single unbalanced shaft offers the advantage that it brings about an excitation in two axes (plane of oscillation).

The connection devices that transmit the oscillation can be situated in the oscillation plane perpendicular to the unbalanced axis at an angle, for example 90°. Here it can be advantageous to position the connection devices approximately radially to the unbalanced axis of the unbalanced shaft. However, this is not required.

Via the operating device, it is possible to stiffen or loosen a single connection device, or a plurality of connection devices, in order to modify the transmission of the oscillation in their direction. Correspondingly, when actuating the operating device in the other direction, a different connection device, or a different set of connection devices having a different orientation, should be stiffened or loosened.

For the transmission of the oscillation, it is not necessary for the stiffness to be set so large that the transmission takes place almost rigidly and the exciter immediately entrains the component that is to be excited. Rather, it is sufficient and advantageous to seek the case of resonance. The transmission device can have at least two connection devices that are not situated in a common oscillation plane. The stiffnesses of these connection devices are then intended to be capable of being set differently relative to a common particular spatial direction. For example, it is possible to situate the two connection devices in axially distributed fashion relative to the unbalanced shaft. In this way, different directional oscillations can be produced that bring about a yaw moment about a vertical axis, so that a vibration plate equipped with the oscillation exciter according to the present invention is made steerable.

A modification of the stiffness of a connection device relative to a spatial direction can be brought about by pivoting the connection device about the axis of rotation of the unbalanced mass. This makes possible a very compact construction of the connection device, or of the transmission device.

Alternatively, a modification of the rigidity of a connection device relative to a spatial direction can also be brought about by pivoting the connection device about a pivot axis that is not identical to the axis of rotation of the unbalanced mass.

In addition, in another specific embodiment of the present invention the connection device can be pivoted together with the unbalanced mass or unbalanced shaft about a pivot axis that is not identical to the axis of rotation of the unbalanced mass. The connection device is then pivoted together with the unbalanced mass relative to the component that is to be charged, in order to achieve different operating states having different directions of effect of the directional oscillation.

The oscillation exciter according to the present invention may be used in a vibration plate or also in a vibration roller. On the basis of the design according to the present invention, it is possible to produce a directional oscillation even with only one unbalanced shaft; in the prior art, this was possible only using two or more unbalanced shafts. In order to change the direction of travel, to deactivate the oscillation effect at the reverse point, or in order to steer, adjustment devices are additionally required. However, these adjustment devices can be made simpler than the adjustment devices previously used to control the various unbalanced shafts and unbalanced masses in known oscillation exciters. The simplification results from the fact that the adjustment devices themselves do not also have to rotate. Rather, only the moved component need be displaced relative to a component that only oscillates and is thus approximately stationary.

These and additional advantages and features of the present invention are explained in more detail in the following on the basis of examples, with the aid of the accompanying Figures.

FIG. 1 shows a first specific embodiment of an oscillation exciter according to the present invention, FIG. 1*a*) showing a lateral sectional view and FIG. 1*b*) showing a sectional top view, while FIG. 1*c*) shows a detail of a connection device.

Figure 1:
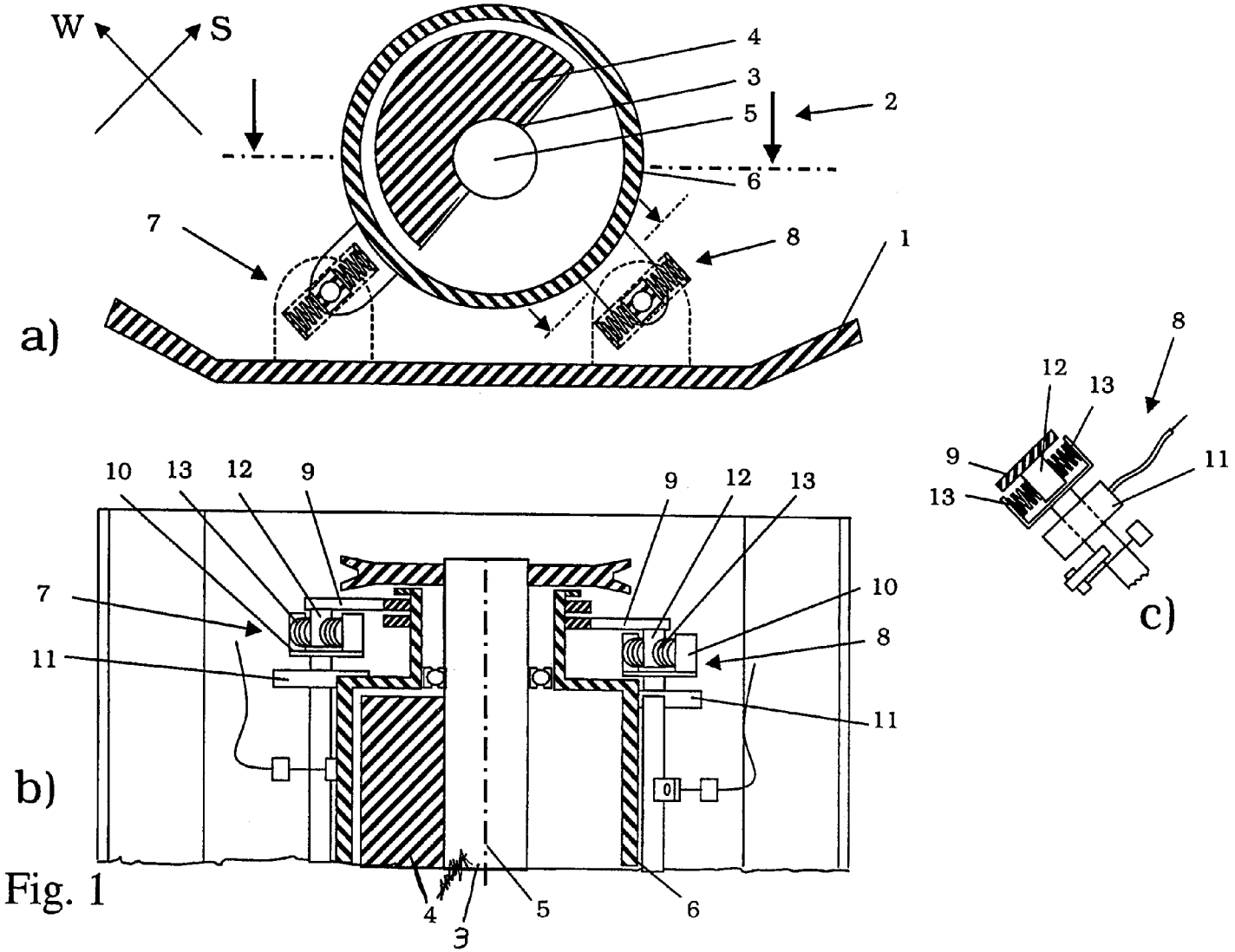
FIG. 1 shows an oscillation exciter according to the present invention according to a first specific embodiment, in a plurality of views.

The oscillation exciter is a component of a vibration plate that comprises soil contact plate 1, acting as a component that is to be excited. On soil contact plate 1, oscillation exciter 2 is situated, having unbalanced shaft 3 that is rotationally driven by a drive (not shown), said shaft driving an unbalanced mass 4 rotationally about an unbalanced axis 5.

Unbalanced shaft 3 is mounted in an unbalanced housing 6 that is connected to soil contact plate 1 via a first connection device 7 and a second connection device 8. Connection devices 7 and 8 form a transmission device for transmitting a non-directional oscillation, produced by rotating unbalanced mass 4, to soil contact plate 1. FIG. 1*c*) shows a partial view of second connection device 8.

Connection devices 7, 8 each have a bracket 9 that is fastened to unbalanced housing 6, and that is capable of being connected to soil contact plate 1 via a pivotable spring device 10 and a mount 11. For this purpose, on bracket 9 a bolt 12 is fastened that is guided in a spring assembly 13. Spring assembly 13 can be pivoted, as is shown in FIGS. 1*a*) and 1*b*). While spring assembly 13 of first connection device 7, shown in FIG. 1, extends in the direction of unbalanced axis 5, spring assembly 13 of second connection device 8 is pivoted by 90° in FIG. 1.

Due to the different relative positions of spring assemblies 13 of the first and second connection device 7, 8, connection devices 7, 8 behave with different stiffnesses relative to rotating unbalanced mass 4 or unbalanced shaft 3. Correspondingly, the non-directional oscillation of rotating unbalanced shaft 3 is transmitted to soil contact plate 1 with different strengths.

Due to the fact that connection devices 7, 8, or spring assemblies 13 appertaining thereto, can be pivoted by at least 90°, the stiffness effects of connection devices 7 and 8 can be modified, which also entails a modified travel behavior of the vibration plate.

In the position of connection devices 7 and 8 shown in FIG. 1, connection device 7 behaves relatively stiffly, because here the oscillation is transmitted via compact spring assemblies 13. In contrast, in the position shown in FIG. 1 connection device 8 behaves rather softly, because the oscillation force coming from unbalanced shaft 3 stands perpendicular to spring assembly 13. The force brings about a deformation of spring assembly 13 perpendicular to its main direction, i.e., in a direction in which only relatively low spring forces can be transmitted.

Correspondingly, the exciter force of unbalanced shaft 13 can also be transmitted to soil contact plate 1 only to a reduced degree via connection device 8.

In FIG. 1*a*), the behavior of connection devices 7 and 8 is identified by the arrows W (soft) and S (stiff).

Soil contact plate 1, excited in the manner shown in FIG. 1, brings about in arrow direction S a compaction of the soil, as well as an advance to the right.

Figure 2:
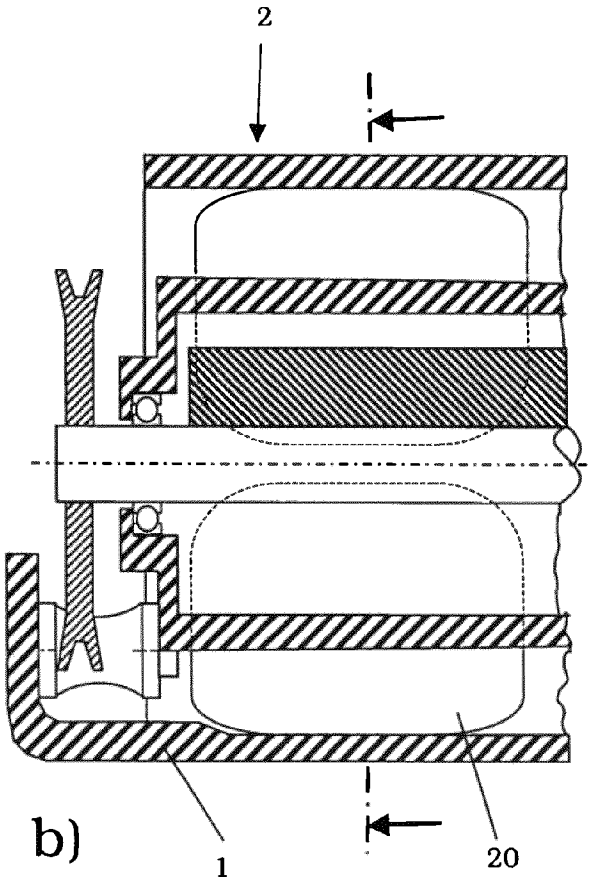
FIG. 2 shows an oscillation exciter according to a second specific embodiment.
Figure 2:
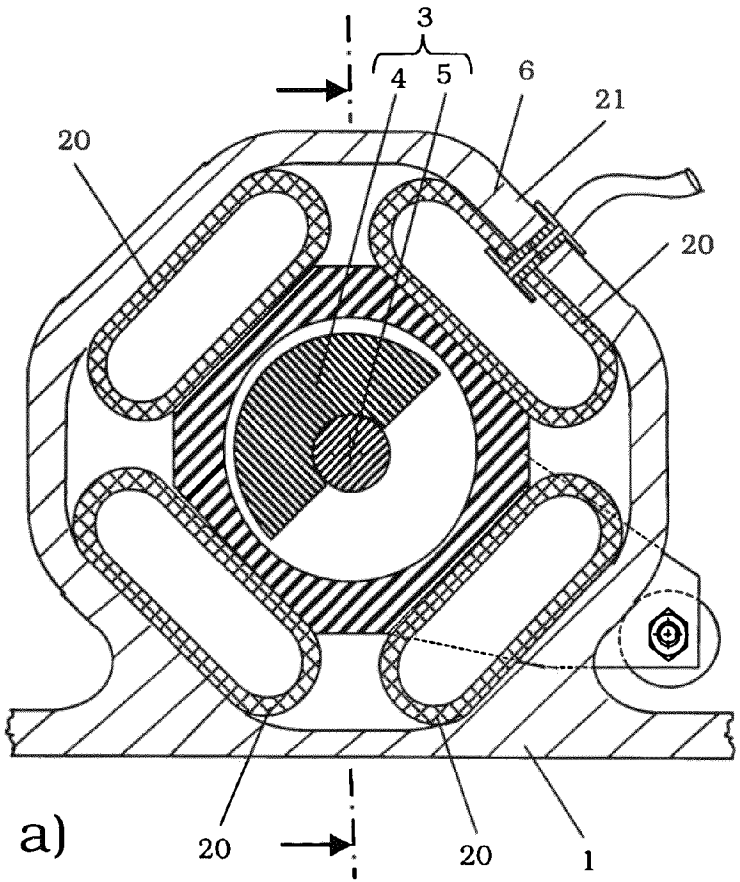

FIG. 2 shows a second specific embodiment of the present invention, FIG. 2*a*) showing a cross-section and FIG. 2*b*) showing a front view (partial section).

The oscillation exciter of the second specific embodiment is also attached to a soil contact plate 1 and, like the first specific embodiment, has an unbalanced shaft 3 having an unbalanced mass 4 that rotates about an unbalanced axis 5. In order to avoid repetition, with regard to these reference is made to the above description.

Unbalanced housing 6 surrounding unbalanced shaft 3 is held by a plurality of cushions or pads 20 in a mount 21 that appertains to soil contact plate 1 and is rigidly connected thereto. Cushions 20 each represent a connection device with which the oscillation produced by unbalanced shaft 3 is transmitted to soil contact plate 1.

Cushions 20 can be rubber cushions that are controlled by an operating element (not shown) and that can be filled with or emptied of a hydraulic fluid. In this way, different stiffnesses of cushions 20 are set, so that the non-directional oscillation of unbalanced shaft 3 is transmitted only in particular directions, and is thus then transmitted to soil contact plate 1 as directional oscillation. In particular, the oscillation forces are transmitted only by those cushions 20 that have been relatively strongly pumped full and are therefore stiff, whereas soft, non-filled cushions 20 compensate the oscillation forces, i.e., do not transmit them to soil contact plate 1. The directional oscillation acting on soil contact plate 1 brings about a compaction and advance effect similar to that of the specific embodiment of FIG. 1.

In FIG. 2*a*), four cushions 20 are shown that are situated uniformly around unbalanced shaft 3 or unbalanced housing 6. In order to avoid lateral swinging, however, at least eight cushions 20, i.e. two axially offset assemblies of four cushions each, should be provided.

If the axially distributed cushions 20 can be set differently with respect to their stiffness, it is possible to turn or steer soil contact plate 1.

Here, cushions 20 take over the function of spring assemblies 13 in the first specific embodiment.

In the specific embodiments shown in FIGS. 1 and 2, in each case the unbalanced shaft 3 is held in fully elastic fashion, even if with different stiffnesses, relative to the soil contact plate. Alternatively, the oscillation exciter can also be realized as a partially elastic exciter, so that in one direction it is connected rigidly to the lower mass (soil contact plate 1), while it may be fastened elastically only in a different direction (e.g. perpendicular to the rigidly fixed direction). Here, the fastening transverse to the direction of travel does not influence the functioning. It may be rigid or elastic.

These specific embodiments are presented in a plurality of further variations in FIGS. 3 through 7, which are described in more detail below.

Thus, for example it is possible for unbalanced shaft 3, or unbalanced housing 6 surrounding it, to be held in one direction in a linear guide, held in a center position by spring elements. Likewise, a connecting rod that is connected radially to unbalanced shaft 3 and is mounted elastically in the pivot direction can represent a suitable mount. The mounting can also be made up of a plurality of levers whose linkage points can be freely selected. In each case, it is to be sought that the circulating non-directional excitation of unbalanced shaft 3 is transmitted to the component to be excited (soil contact plate 1) only in one spatial direction, while in particular the movement transverse thereto of unbalanced shaft 3 is not hindered, so that only very small excitation forces are transmitted in this second direction due to the isolating effect of the elastic fastening.

Figure 3:
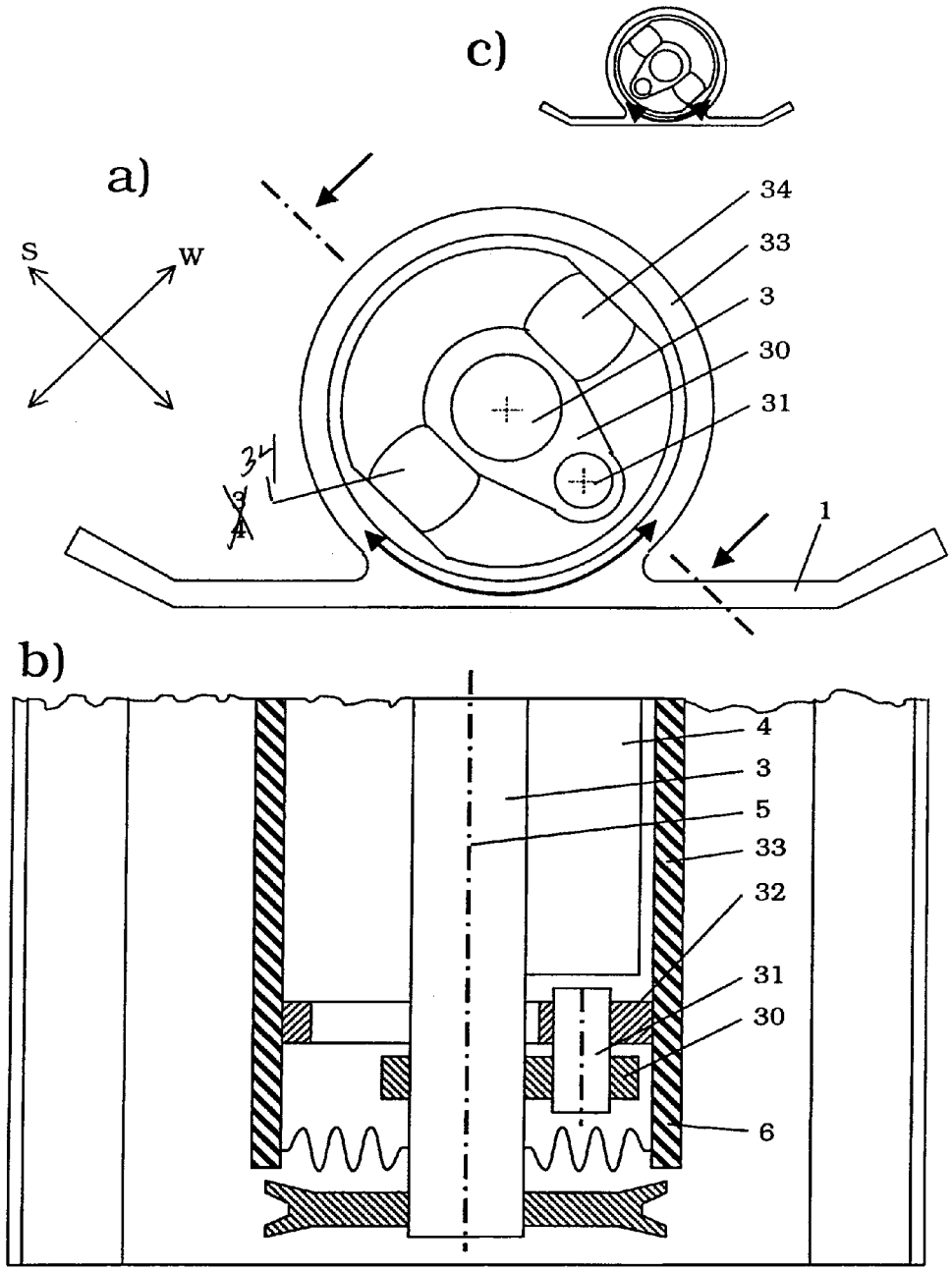
FIG. 3 shows a third specific embodiment of an oscillation exciter according to the present invention.

In order to modify the direction of action of the unbalanced force, for example the mounting element (the connection device) can then be adjusted by turning. If for example a single connecting rod represents a connection device, provided at an end of unbalanced shaft 3, while another individual connecting rod is situated at the other end of unbalanced shaft 3, the associated linkage point to unbalanced shaft 3 is then to be turned about unbalanced axis 5. FIG. 3 shows a third specific embodiment of the present invention, FIG. 3*a*) showing a side view, FIG. 3*b*) showing a sectional top view, and FIG. 3*c*) showing a side view with a modified direction of oscillation.

Unbalanced shaft 3 is mounted at both sides in a bracket 30 via a bearing (not shown in the Figure), said bracket being connected pivotably to a disk 32 via a bolt 31. Disk 32 is held pivotably in a mount 33 that surrounds unbalanced shaft 3 and that is rigidly connected to soil contact plate 1.

Bracket 30, bolt 31, and disk 32 together form a first connection device that ensures a stiff connection in the direction of arrow S (FIG. 3*a*) between unbalanced shaft 3 and mount 33. A second connection device is formed by spring elements, e.g. rubber cushions 34, that are situated between the end of bracket 30, acting as the bearing of unbalanced shaft 3, and mount 33.

Correspondingly, rubber cushions 34 bring about an elastic, relatively soft connection in the direction of arrows W (FIG. 3*a*).

During operation of the oscillation exciter, unbalanced shaft 3 rotates, and, due to the circulating unbalanced action of unbalanced mass 4, has the tendency to press outward. This movement of unbalanced shaft 3 is prevented by the stiff construction of first connection device in arrow direction S. Given further rotation by 90°, unbalanced mass 4 acts in the direction of the second, soft connection device, where rubber cushions 34 exert only a slight resilient resistance. Accordingly, only a relatively low force is transmitted to mount 33 and thus to soil contact plate 1. Bracket 30 of the first connection device can be freely pivoted via bolt 31, and thus does not obstruct this compensatory movement.

The first and the second connection device can for example be pivoted in common by an angle of 90°, as is shown in FIG. 3*c*). In this case, the stiff and the soft connection devices exchange places, so that an oscillation effect is transmitted in a different direction. In this way, the direction of travel of the vibration plate can be modified.

Of course, two connection devices must also be provided in an analogous manner at the opposite end (not shown in FIG. 3) of unbalanced shaft 3.

Figure 4:
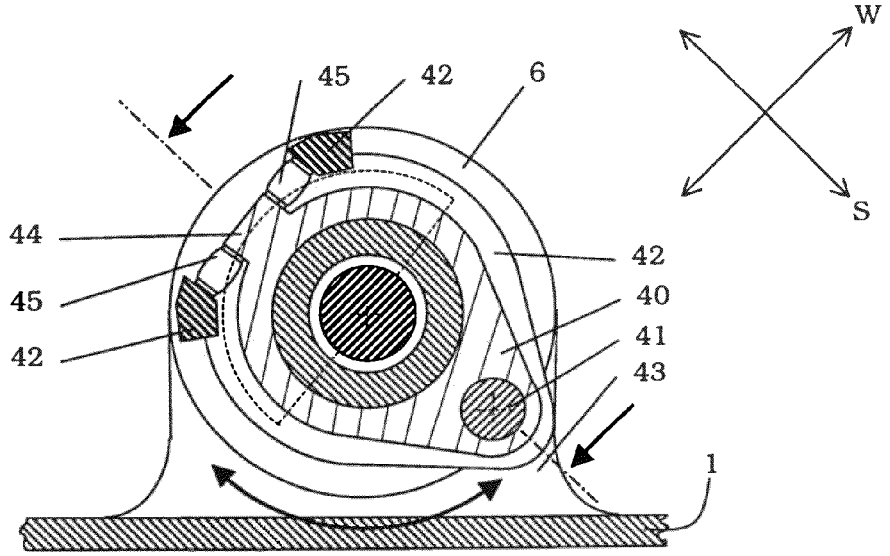
FIG. 4 shows a fourth specific embodiment of an oscillation exciter according to the present invention.
Figure 4:
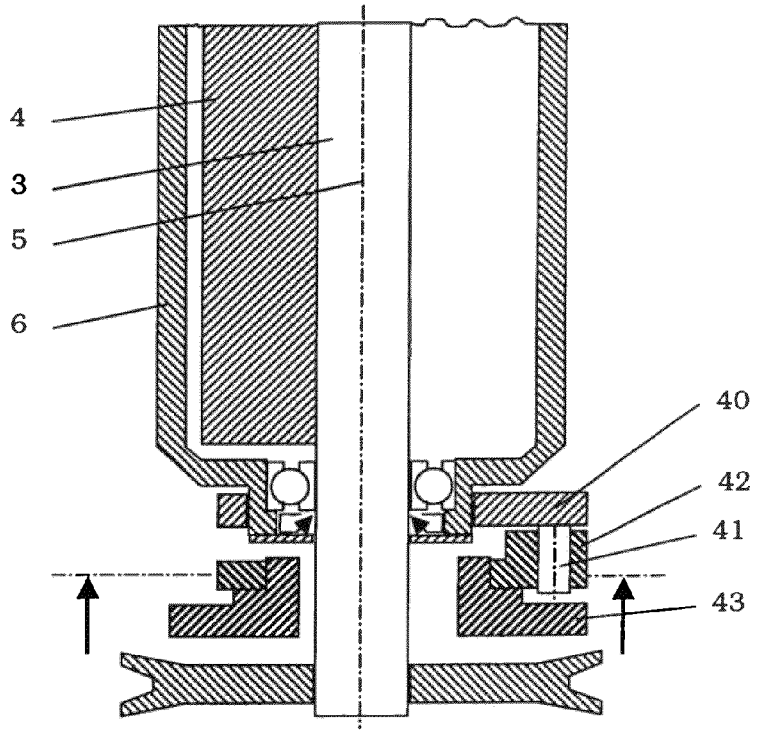

FIG. 4 shows a fourth specific embodiment of the present invention whose principle of operation is similar to that of the third specific embodiment. FIG. 4*a*) shows a side view, and FIG. 4*b*) shows a sectional top view of the fourth specific embodiment.

Unbalanced shaft 3 is surrounded by unbalanced housing 6 and is held by this housing. To unbalanced housing 6 there is connected a connecting rod 40 that is pivotably coupled to a disk 42 via a bolt 41. Disk 42 is held on a mount 43 so as to be capable of rotation. Mount 43 is connected rigidly to soil contact plate 1.

Connecting rod 40 has a catch 44 against which rubber cushions 45 abut, said cushions being supported on the opposite side on disk 42.

Connecting rod 40, bolt 41, and disk 42 form a first connection device that is stiff in arrow direction S (FIG. 4*a*). In contrast, rubber cushions 45 form a second connection device that is elastic in arrow direction W and thus behaves relatively softly. Thus, the circulating, non-directional oscillation of unbalanced shaft 3 can be transmitted to soil contact plate 1 only in arrow direction S. If the unbalanced force of unbalanced mass 4 acts in the direction of arrow W, the second connection device yields and connecting rod 40 pivots about bolt 41.

Correspondingly, no force, or only a slight force, is transmitted.

Through pivoting of disk 42, the directional effects of the first and second connection device are modified, so that the correspondingly modified transmission of oscillation can bring about a different, reverse direction of travel.

Figure 5:
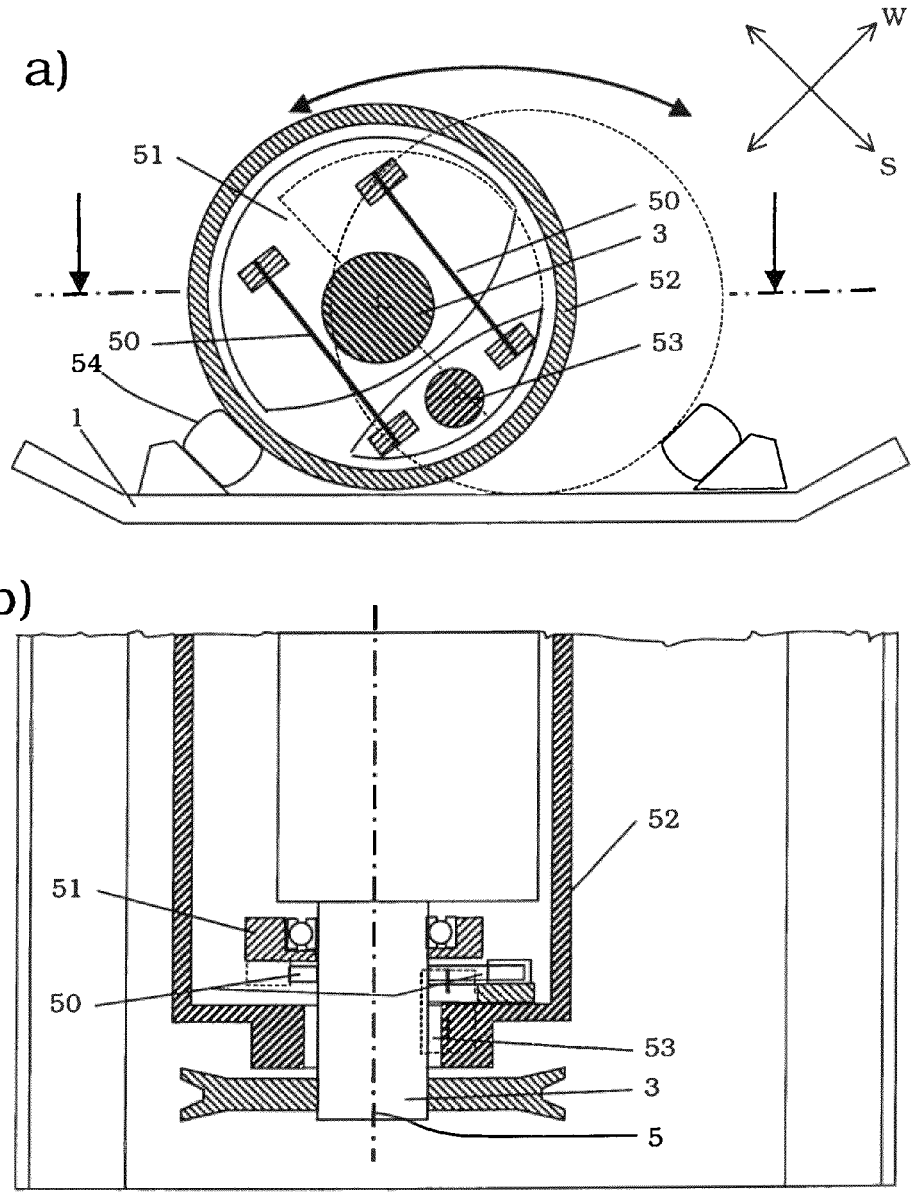
FIG. 5 shows a fifth specific embodiment of an oscillation exciter according to the present invention.

FIG. 5 shows a fifth specific embodiment of the present invention, FIG. 5*a*) showing a lateral sectional view and FIG. 5*b*) showing a sectional top view.

Instead of the previously depicted levers and connecting rods, in the fifth specific embodiment of the present invention unbalanced shaft 3 is held on the lower mass via elastic elements, in particular plate springs 50. Plate springs 50 are able to transmit large forces in the longitudinal direction due to the high degree of stiffness that is then in effect, while in the transverse direction the springs are softly resilient, i.e. they compensate oscillatory movements.

Unbalanced shaft 3 is mounted in a bearing shell 51 that in turn is held in a housing 52 via two plate springs 50. Housing 52 is mounted pivotably on a tilt axle 53, as is shown in FIG. 5*a*). The end positions are defined by stops 54. Tilt axle 53 and stops 54 are rigidly connected to soil contact plate 1.

Correspondingly, the unbalanced force of unbalanced shaft 3 can be transmitted via plate springs 50 in arrow direction S (FIG. 5*a*), i.e. in the longitudinal direction of plate springs 50, due to the largely rigid connection in this direction. Due to the elastic effect of plate springs 50 in a direction transverse thereto, no, or only a slight, exciter force is transmitted in arrow direction W. In order to change direction, the orientation of plate springs 50 must be turned. Here it is not necessary for the point of rotation to be situated on unbalanced axis 5. Rather, as also shown in FIG. 5, the point of rotation can lie on tilt axle 53. It is also possible to provide a virtual point of rotation that is determined by a plurality of connecting rods.

In order to rotate the orientation of plate springs 50, the entire housing 52, together with plate springs 50 borne thereby and unbalanced shaft 3, is pivoted about tilt axle 53, against the respective oppositely situated stop 54. Thus, the entire oscillation exciter can be pivoted between the position shown in FIG. 5*a*) and a position shown in broken lines in FIG. 5*a*). The direction of the directional oscillation (arrow direction S) is modified correspondingly, e.g. over an angle of 90°.

Plate springs 50 thus integrate two connection devices in one component type: the stiff action of plate springs 50 in their longitudinal direction represents a first connection device, while the soft, elastic spring property of the plate springs in the transverse direction is to be regarded as a second connection device.

Many vibration plates are made to travel back and forth during operation. Here it is often desirable for the exciter force to be almost eliminated at the changeover or reverse point, so that soil contact plate 1 is as still as possible even though unbalanced shaft 3 is driven and rotating. For this purpose, in the oscillation exciter according to the present invention it makes sense for all fasteners in the oscillation exciter plane to be released, so that rotating unbalanced shaft 3 is then held only in an elastic bearing.

Figure 6:
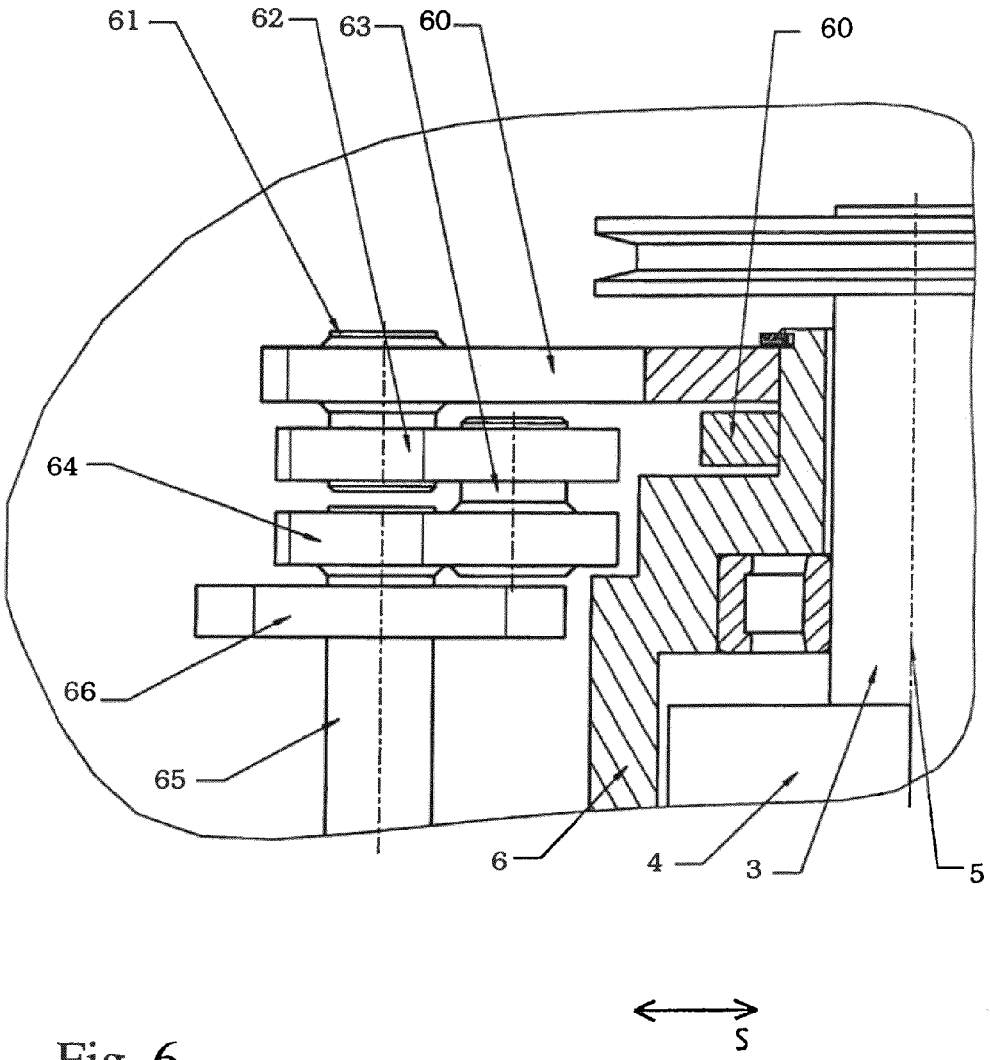
FIG. 6 shows a sixth specific embodiment of an oscillation exciter according to the present invention.

This is possible for example using a system of connecting rods such as those of the sixth specific embodiment, shown in FIG. 6.

Unbalanced shaft 3 is mounted in unbalanced housing 6 in a known manner. At the level of each shaft end, unbalanced housing 6 is held on two long connecting rods 60 that stand at an angle of e.g. 90° to one another and that lead downward in the direction of soil contact plate 1. In FIG. 6, the two long connecting rods 60, offset axially to one another, are only partly visible. To this extent, FIG. 6 shows only one quadrant of the overall representation; the other quadrants would show a similar or identical construction with respect to the function of the connecting rods, explained in the following.

Long connecting rod 60 is connected to a bolt 61 on which a first short connecting rod 62 is held pivotably. First short connecting rod 62 is connected pivotably to a second short connecting rod 64 via a bolt 63. Second short connecting rod 64 is in turn fastened rigidly to a guide rod 65 that is attached to soil contact plate 1 via a mount 66. In the initial position, the two short connecting rods 62, 64 are situated parallel to one another; however, they can be pivoted relative to one another via bolt 63.

In the position shown in FIG. 6, the connection device is rigid in arrow direction S along the longitudinal extension of long connecting rod 60, while it is soft in a direction perpendicular thereto (perpendicular to the plane of the drawing), because in this direction first short connecting rod 62 can be pivoted relative to long connecting rod 60 and to second short connecting rod 64.

Guide rod 65 can be pivoted about an angle of e.g. 90°, and in so doing carries along second short connecting rod 64 that is connected fixedly to it; rod 64 then in turn also causes first short connecting rod 62 to pivot about bolt 61. Long connecting rod 60, in contrast, remains in the position shown in FIG. 6.

Due to the fact that first short connecting rod 62 is now no longer parallel to long connecting rod 60 but rather extends at a right angle thereto, a longitudinal movement of long connecting rod 60, due to relative pivot movements between long connecting rod 60 and short connecting rods 62 and 64, is no longer transmitted to guide rod 65 or to mount 66. As a result, the connection is now soft. Oscillatory movements coming from unbalanced shaft 3 or from unbalanced housing 6 are compensated by relative movements of the connecting rods, and are not transmitted to mount 66 and thus to soil contact plate 1.

If short connecting rods 62, 64 are set parallel to long connecting rod 60, the unbalanced force in the direction of long connecting rod 60 is transmitted to the lower mass. If, in contrast, short connecting rods 62, 64 stand perpendicular to long connecting rod 60, the connection is released, so that unbalanced shaft 3 is then held only elastically at this point. Thus, in order to change the direction of travel, first the fastening should be released by pivoting guide rod 65 (connection device soft), and then the other fastening should be activated (connection device stiffened). In this way, at the reverse point the action of centrifugal force can be practically deactivated.

By setting intermediate positions of short connecting rods 62, 64, the transmitted unbalanced force can also be adjusted continuously and very quickly.

In order to avoid exposing the operator to unnecessary vibrational stress, an operating lever should be connected elastically to the adjustment mechanism, i.e. guide rod 65. The operating forces that are required are then comfortably small.

The lever or connecting rod system made up of long connecting rod 60 and short connecting rods 61, 64, as well as bolts 61, 63, represents a first connection device to which a corresponding second connection device, situated opposite (not shown in FIG. 6), is allocated, acting essentially in the same oscillation plane. Corresponding connection devices are also to be provided in the other quadrants that would result given corresponding mirroring of the representation of FIG. 6.

Figure 7:
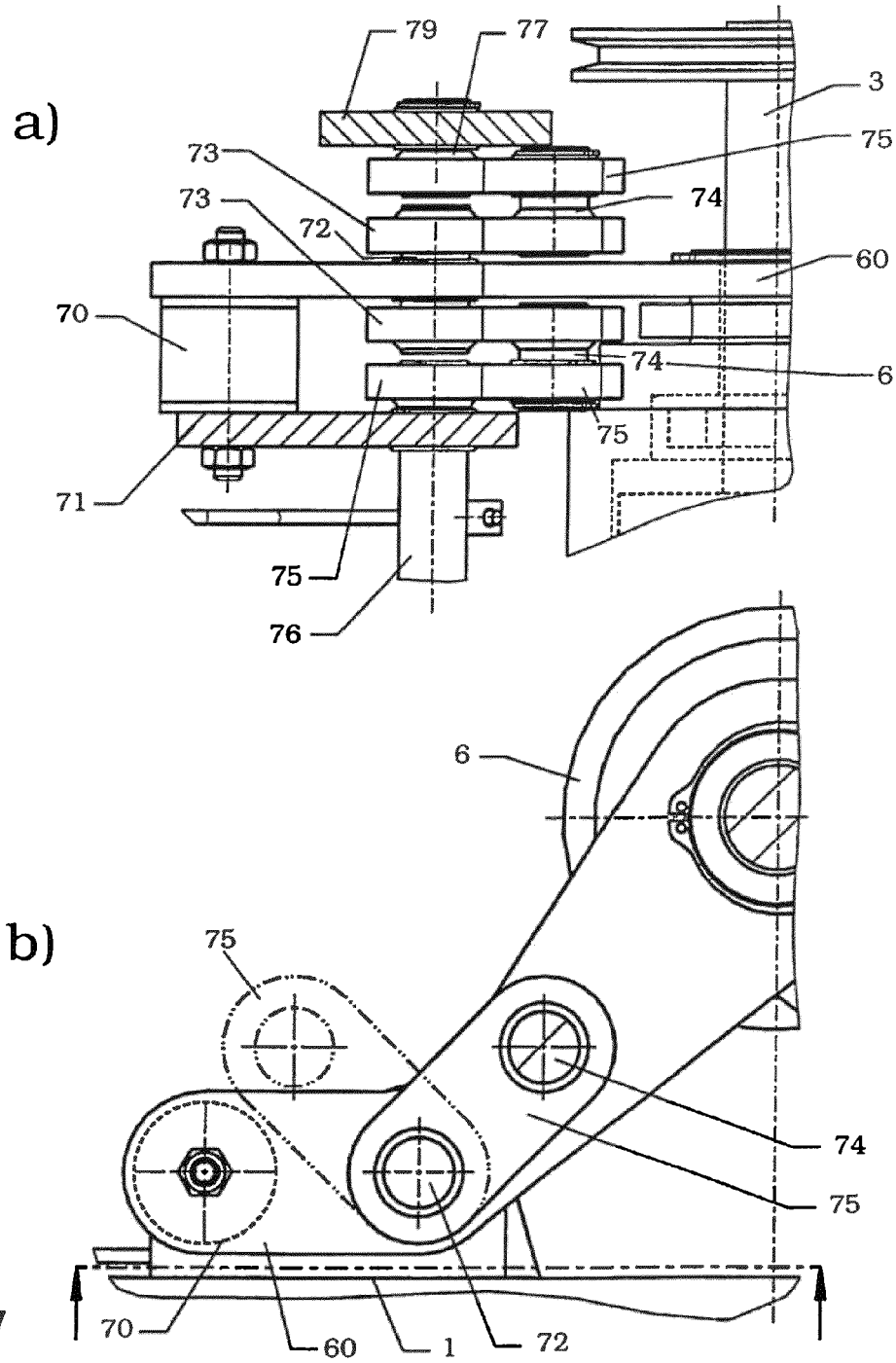
FIG. 7 shows a seventh specific embodiment of an oscillation exciter according to the present invention.

As a variant of FIG. 6, FIG. 7 shows a seventh specific embodiment of the present invention in a top view (FIG. 7*a*) and in a side view (FIG. 7*b*).

In contrast to the sixth specific embodiment, the seventh specific embodiment has a double bracket guide in order to reduce bending moments in the joints of the connecting rods. Identical reference characters have been used for components that are identical or similar to those of the sixth specific embodiment shown in FIG. 6.

Unbalanced housing 6 is held by a (or a total of four) long connecting rod 60 that is supported on a mount 71 via a rubber cushion 70. Mount 71 is rigidly connected to the lower mass, or soil contact plate 1.

Approximately in its center, long connecting rod 60 is penetrated by a bolt 72, bearing on both sides first short connecting rods 73, symmetrically and pivotable relative to long connecting rod 60.

Each first short connecting rod 73 bears a bolt 74, on each of which a second short connecting rod 75 is in turn pivotably fastened.

One of the second short connecting rods 75 is fixedly connected to a guide rod 76 that can be pivoted in a manner analogous to the sixth specific embodiment shown in FIG. 6.

The other (in FIG. 7, the upper) short connecting rod 75 is pivotably fastened via a bolt 77 to a mount 79 that is rigidly connected to soil contact plate 1.

By pivoting guide rod 76, held in mount 71, all the short connecting rods 73, 75 are likewise pivoted via bolt 72, and can thus be displaced from their position parallel to long connecting rod 60 (shown in FIG. 7) into a position perpendicular to long connecting rod 60 (this position is shown in broken lines in FIG. 7*b*). In this position, the system does not transmit any vibration forces to the lower mass.

In contrast, in the position shown in FIG. 7, in which short connecting rods 73, 75 stand parallel to long connecting rod 60, a fairly rigid connection is ensured that introduces the vibration forces acting along long connecting rod 60 into soil contact plate 1.

Figure 8:
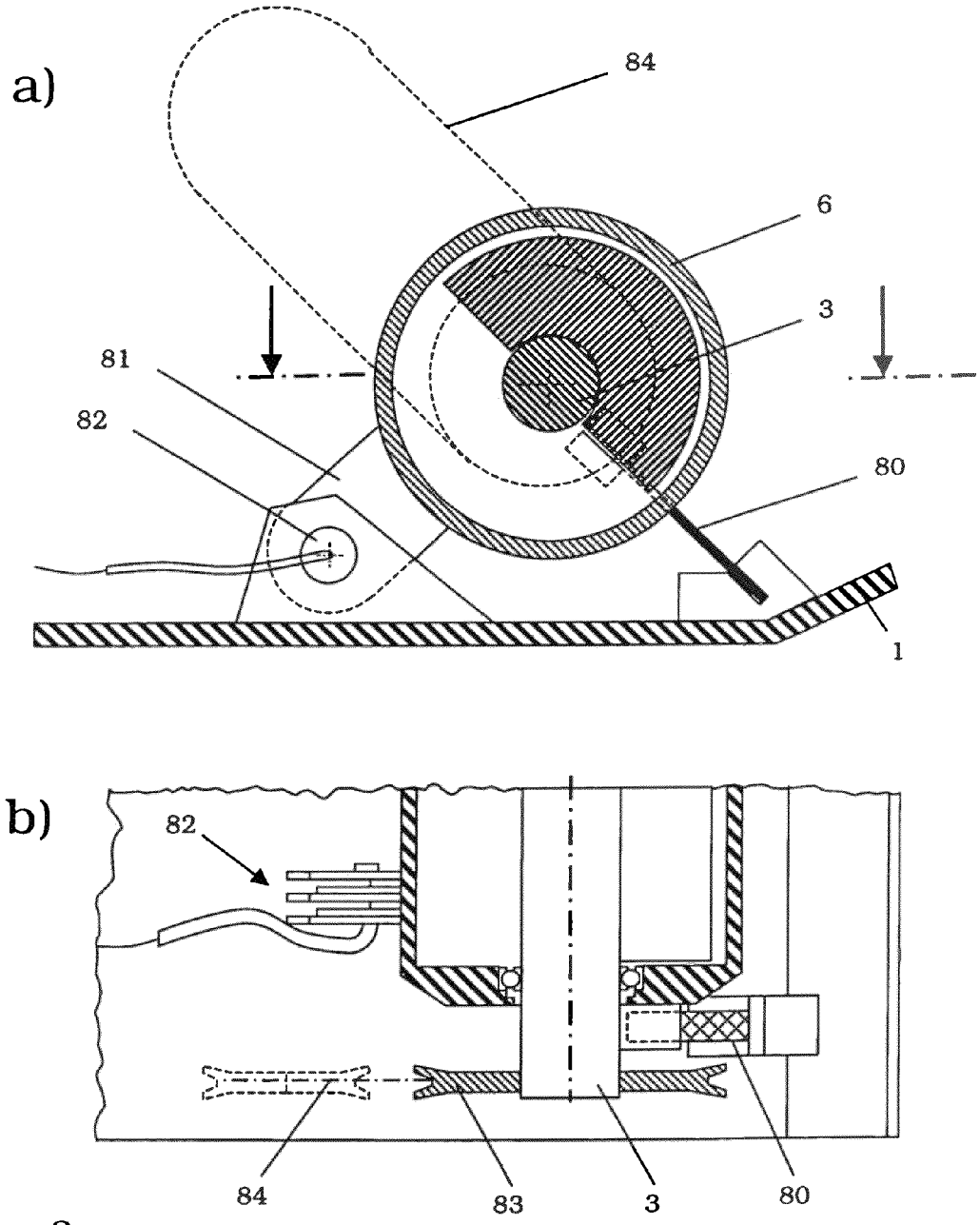
FIG. 8 shows an eighth specific embodiment of an oscillation exciter according to the present invention.

FIG. 8 shows an eighth specific embodiment of the present invention in a schematic side view (FIG. 8*a*) and in a top view (FIG. 8*b*).

The eighth specific embodiment differs from the specific embodiments described above in that the fastening by a connection device is permanent in one direction, while the fastening by another connection device can be detached as needed in another, preferably perpendicular direction, so that in this direction only an elastic basic securing then remains.

On one side, the unbalanced housing 6 surrounding unbalanced shaft 3 is connected to soil contact plate 1 via a plate spring 80. Plate spring 80 transmits vibration forces along its longitudinal direction, but yields resiliently in the transverse direction.

At an angle of approximately 90° thereto, a plurality of brackets 81, situated so as to be distributed axially, are fastened to unbalanced housing 6 and lead to a multiple disk brake 82. When activated, multiple disk brake 82 blocks the degree of freedom provided by plate spring 80, namely the pivoting about the fastening point of plate spring 80 to soil contact plate 1. In this operating state, the vibration plate behaves like a plate compactor, and enables a permanent forward travel due to the rigid coupling in all directions.

When multiple disk brake 82 is released, it is possible to travel backward with a directional oscillation.

A drive belt 84, provided in order to drive unbalanced shaft 3 via a pulley 83, can be led away along the longitudinal direction of plate spring 80, as is shown in FIG. 8*a*). In this way, the oscillatory movements of unbalanced housing 6 have the least effect on a modification of the belt length, which protects drive belt 84.

Figure 9:
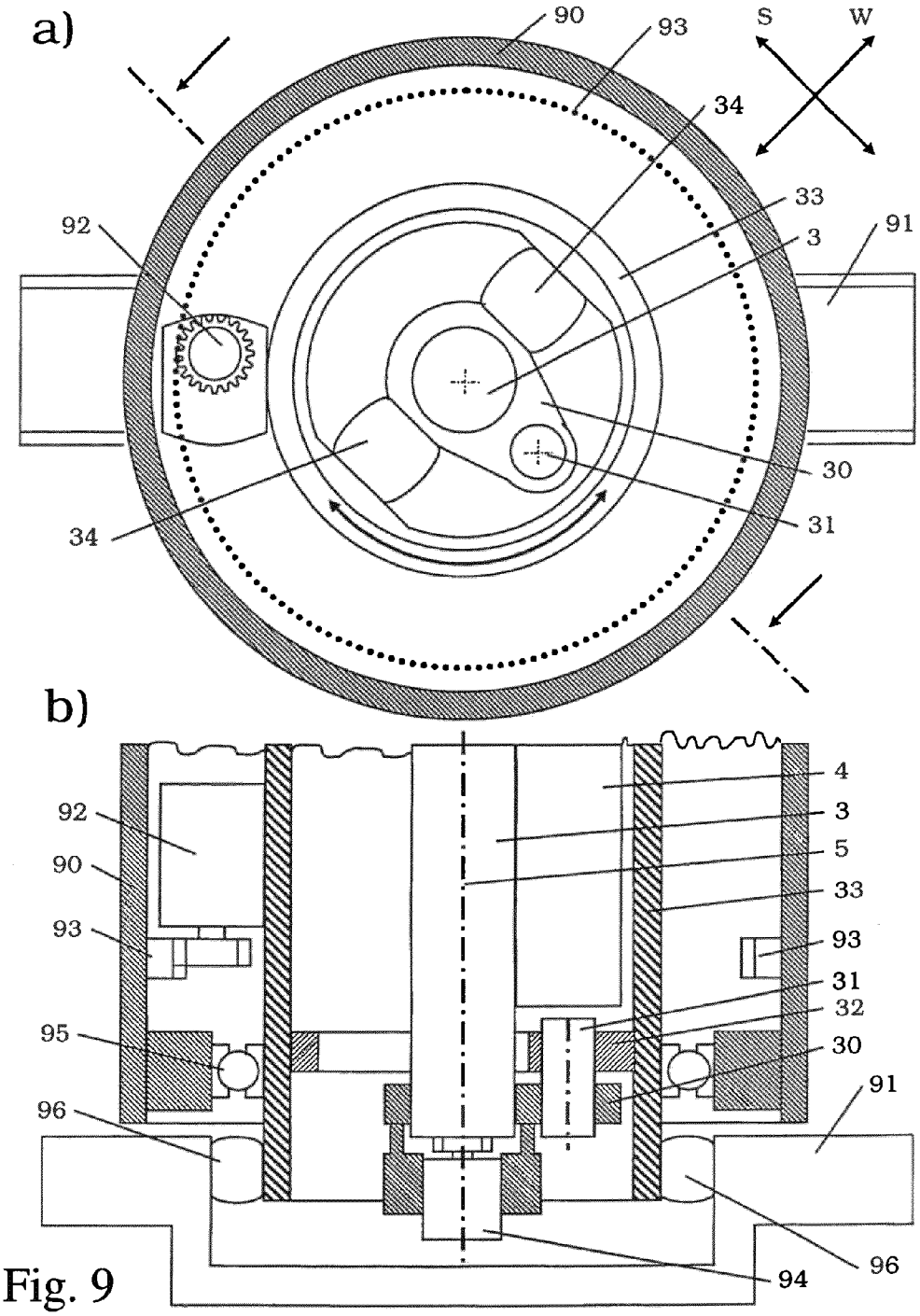
FIG. 9 shows a variant of the oscillation exciter according to the present invention, in use in a vibration roller.

FIG. 9 shows another specific embodiment of the present invention, having an example of the use of the oscillation exciter according to the present invention in a vibration roller for soil compaction. FIG. 9*a*) is a sectional representation through the roller. FIG. 9*b*) shows a partial section in top view.

The specific embodiment of FIG. 9 is based on the variant shown in FIG. 3. Therefore, identical reference characters have been used for identical or similar components. Moreover, the manner of functioning of the device of FIG. 3 is not described again.

The oscillation exciter of FIG. 3 is built into a roll tire 90 that is held via a bearing 95 on mount 33 of the oscillation exciter. Mount 33 is held in a tire frame 91 (shown only schematically) via elastic bearings 96.

Roll tire 90 is driven rotationally by a travel drive 92 via an internal toothing 93, in order to cause the vibration roller to travel.

Unbalanced shaft 3 is rotationally driven by an unbalanced shaft drive 94 in order to produce the desired oscillations.

The oscillation exciter according to the present invention produces an essentially directional oscillation that can be transmitted to roll tire 90 and thus to the soil that is to be compacted.

The invention claimed is:

1. A vibration plate for soil compaction, comprising:

an oscillation exciter having at least one unbalanced mass that is driven rotationally about at least one unbalanced axis in order to produce a non-directional oscillation;

a soil contact plate that is excited by the oscillation exciter;

a transmission device that connects the unbalanced mass to the soil contact plate in order to transmit the oscillation to the soil contact plate; wherein through the transmission device, non-directional oscillation from the unbalanced mass is capable of being converted into an essentially directional oscillation, modifiable with regard to its direction and/or intensity, for the soil contact plate; wherein the direction and/or the intensity of the directional oscillation is capable of being modified during operation by an operating element or a control device; wherein the transmission device has at least two connection devices situated in a transmission path of the oscillation from the unbalanced mass to the soil contact plate; wherein the stiffness of at least one of the connection devices is independent of the stiffness of the other connection device; and wherein the modification of the stiffness of the one connection device relative to a spatial direction can be accomplished by pivoting the one connection device about the axis of rotation of the unbalanced mass.

2. The vibration plate as recited in claim 1, wherein the transmission device is constructed in such a way that it has, relative to a plane of oscillation, different stiffnesses in different directions within the plane of oscillation.

3. The vibration plate as recited in claim 2, wherein the stiffnesses are capable of being modified during operation.

4. The vibration plate as recited in claim 1, wherein the stiffness of one of the connection devices can be individually set during operation in such a way that it differs from the stiffness of the other connection device.

5. The vibration plate as recited in claim 1, wherein the connection devices are situated in parallel with and/or in series with one another, relative to the transmission path of the oscillation.

6. The vibration plate as recited in claim 1, wherein the stiffnesses have a directional component and a magnitude component, and wherein, correspondingly, the stiffness effect of at least one of the connection devices is capable of being modified with respect to its direction effect and/or its magnitude.

7. The vibration plate as recited in claim 1, wherein the stiffnesses of the connection devices differ from one another in such a way that they differ with respect to a particular spatial direction.

8. The vibration plate as recited in claim 1, wherein the magnitude component of the stiffness of at least one of the connection devices is not modifiable, but the directional component of the stiffness is modifiable as a function of a modifiable orientation of the connection device to the unbalanced mass.

9. The vibration plate as recited in claim 1, wherein the magnitude component of the stiffness of at least one of the connection devices is not modifiable, but the connection device provides different stiffness effects in different spatial directions thereof.

10. The vibration plate as recited in claim 1, wherein:

the non-directional oscillation and the directional oscillation run essentially in an oscillation plane perpendicular to the unbalanced axis;

the transmission device has, in a first spatial direction lying in the oscillation plane, a first connection device, acting in the first spatial direction, for the unbalanced mass, and has, in a second spatial direction differing from the first spatial direction and lying in the oscillation plane, a second connection device, acting in the second spatial direction, for the unbalanced mass; and wherein the stiffnesses of the connection devices relative to their respectively allocated spatial directions are permanently or temporarily different.

11. The vibration plate as recited in claim 1, wherein, in a particular operating state, the connection devices are controllable in such a way that the stiffnesses of the connection devices are equal.

12. The vibration plate as recited in claim 1, wherein the connection devices are controllable in such a way that, in a reversing operating state, all connection devices have a low stiffness.

13. The vibration plate as recited in claim 1, wherein the stiffness of the connection devices is modifiable between at least two stiffness effects.

14. The vibration plate as recited in claim 1, wherein the stiffnesses of the connection devices are modifiable in a sliding fashion.

15. The vibration plate as recited in claim 1, wherein at least one of the connection devices has at least one damping device, a friction-fit device, a positively fitting fastening, or a spring device.

16. The vibration plate as recited in claim 1, wherein at least one of the connection devices has a plurality of levers that are pivotably connected to one another and that, depending on the pivot position, enable a different stiffness relative to a particular spatial direction.

17. The vibration plate as recited in claim 1, wherein an operating device is provided in order to modify the stiffness of at least one of the connection devices.

18. The vibration plate as recited in claim 1, wherein:

the transmission device has at least two connection devices that are situated in different oscillation planes from one another; and the stiffnesses of the connection devices can be set to be different relative to a common particular spatial direction.

19. A vibration plate for soil compaction, comprising:

an oscillation exciter that includes at least one unbalanced mass that is driven rotationally about at least one unbalanced axis in order to produce a non-directional oscillation having an oscillation intensity that is at least generally equal in all directions;

a soil contact plate that is excited by the oscillation exciter;

a transmission device that transmits the oscillation to the soil contact plate from the unbalanced mass, the transmission device converting the oscillation imposed on the soil contact plate to an essentially directional oscillation having an oscillation intensity that is greater in at least one direction than in at least one other direction, the transmission device including at least two connection devices situated in an oscillation transmission path leading from the unbalanced mass to the soil contact plate, the stiffness of at least one of the connection devices being independent of the stiffness of the other connection device; and a control device or an operating element that is operable during operation of the vibration plate to pivot the one connection device about the axis of rotation of the unbalanced mass to modify the stiffness of the one connection device relative to a spatial direction and modify at least one of the direction and the intensity of the directional oscillation.

* * * * *